US008632309B2

(12) United States Patent
Tsypkaykin et al.

(10) Patent No.: US 8,632,309 B2
(45) Date of Patent: Jan. 21, 2014

(54) BLADE FOR A GAS TURBINE

(75) Inventors: Igor Tsypkaykin, Turgi (CH); Ruben Valiente, Madrid (ES); Brian Kenneth Wardle, Brugg-Lauffohr (CH); Beat Von Arx, Trimbach (CH); Andre Saxer, Mellingen (CH)

(73) Assignee: Alstom Technology Ltd, Baden (CH)

( * ) Notice: Subject to any disclaimer, the term of this patent is extended or adjusted under 35 U.S.C. 154(b) by 45 days.

(21) Appl. No.: 13/091,605

(22) Filed: Apr. 21, 2011

(65) Prior Publication Data

US 2011/0286849 A1 Nov. 24, 2011

Related U.S. Application Data

(63) Continuation of application No. PCT/EP2009/063367, filed on Oct. 13, 2009.

(30) Foreign Application Priority Data

Oct. 23, 2008 (EP) ..... 08167378

(51) Int. Cl.
*F01D 5/14* (2006.01)

(52) U.S. Cl.
USPC ..... 416/195; 415/173.5; 415/173.6

(58) Field of Classification Search
USPC ..... 415/194, 195, 191, 196 R; 416/173.1, 416/173.3, 173.5, 173.6
See application file for complete search history.

(56) References Cited

U.S. PATENT DOCUMENTS

| | | | | |
|---|---|---|---|---|
| 5,350,277 | A | 9/1994 | Jacala et al. | |
| 6,491,498 | B1 | 12/2002 | Seleski et al. | |
| 7,527,477 | B2 * | 5/2009 | Norton et al. | 416/191 |
| 7,628,587 | B2 * | 12/2009 | McFeat et al. | 416/189 |
| 2005/0042092 | A1 | 2/2005 | Boegli et al. | |
| 2005/0079058 | A1 | 4/2005 | Paquet et al. | |
| 2008/0019835 | A1 | 1/2008 | McFeat et al. | |
| 2008/0025841 | A1 | 1/2008 | Norton et al. | |
| 2009/0214328 | A1 | 8/2009 | Tibbott et al. | |

FOREIGN PATENT DOCUMENTS

| | | | |
|---|---|---|---|
| EP | 1 591 625 | A1 | 11/2005 |
| EP | 1 788 195 | A2 | 5/2007 |
| EP | 1788195 | A2 * | 5/2007 |
| EP | 1 890 008 | A2 | 2/2008 |
| JP | 2005-207294 | A | 8/2005 |

OTHER PUBLICATIONS

International Search Report (PCT/ISA/210) dated Feb. 16, 2010.
European Search Report (EPO Form 1507N) dated Apr. 8, 2009.
Invitation Pursuant to Article 94(3) and Rule 71(1) EPC dated Dec. 21, 2012 issued by the European Patent Office in corresponding European Patent Application No. 08 167 378.2.

* cited by examiner

*Primary Examiner* — Nathaniel Wiehe
*Assistant Examiner* — Justin Seabe
(74) *Attorney, Agent, or Firm* — Buchanan Ingersoll & Rooney PC

(57) ABSTRACT

A blade is disclosed for a gas turbine including an airfoil, which extends along a longitudinal axis from a blade root to a blade tip, and has a shroud segment at the blade tip. The shroud segment abuts with first and second edges against shroud segments of adjacent blades to form a ring-like shroud. The first and second edges are each provided with a respective side rail on the upper side of the shroud segment. Each of the side rails is subdivided into sections of different height and/or width.

18 Claims, 4 Drawing Sheets

AD – AD

AE – AE

AF – AF

BLADE FOR A GAS TURBINE

RELATED APPLICATION

This application claims priority under 35 U.S.C. §119 to European Patent Application No. 08167378.2 filed in Europe on Oct. 23, 2008, the entire content of which is hereby incorporated by reference in its entirety.

FIELD

The present disclosure relates generally to the field of gas turbines and to a blade of a gas turbine.

BACKGROUND INFORMATION

Gas turbine rotor blades can include blade shroud segments in order to control and minimize leakage flow between the blade tips and the surrounding stator as well as to limit vibration amplitudes. A blade shroud segment can include a platform extending in a plane essentially parallel to the stator opposite to the blade tip and one or more fins, which extend circumferentially and radially outward toward the stator.

The platform of a blade shroud segment can be shaped such that its edges are parallel to those of an adjacent blade shroud platform. In order to withstand the high thermal load during gas turbine operation the blade shroud can be cooled by a cooling fluid (for example, cooling air) passing through a cooling system within the platform of the shroud that is fluidly connected to a hollow interior of a blade airfoil.

The shroud lifetime can be limited by mechanical stresses caused, for example, by centrifugal forces. Such stresses can be reduced by minimizing a wall thickness of the platform, also known as a shroud web. However, a blade shroud segment with a thin wall thickness may not line up with the blade shroud segment of an adjacent blade due to manufacturing and assembly tolerances, which can occur even if the tolerances are kept at a minimum.

A further mismatch can result from deformations of the shroud platform during turbine operation due to thermal and mechanical loading. A mismatch between two adjacent blade shroud segments can allow hot gas to enter the cavity between the stator and the blade shroud. The shroud can be designed with materials having a creep resistance and oxidation resistance up to a temperature less than a temperature of the hot gas. Hot gas ingestion therefore can cause premature failure of the shroud and the adjacent static and moving components.

EP-A1-1 591 625 discloses a gas turbine blade with a shroud segment which includes a platform extending, for example, in a plane essentially matching a contour of a stator opposite a blade tip, and side rails that extend radially and along one or both edges of a platform that faces a platform of an adjacent gas turbine blade shroud segment.

An increase of a wall thickness can result in an increase of the stiffness of a component according to a third power of the wall thickness. The blade shroud segment of EP-A1-1 591 625 has an increased wall thickness that is limited to side regions of the platform. Thus, the benefits of increased stiffness can be achieved with a resulting decrease in deformation and bending in the radial outward direction and increased time of turbine operation. The increase in wall thickness can be localized such that it causes no significant increase in the mass of the shroud segment and no significant increase of the mechanical loading.

However, in known shroud segments there is either no side rail or a constant height side rail. The disclosure relates to geometry of the side rails for blade shroud segment coupling which can provide simplified manufacturing, minimization of hot gas ingestion, improved stiffness and improved shroud cooling.

SUMMARY

A blade is disclosed for a gas turbine, including a blade root, a blade tip and a shroud segment formed of the blade tip and an airfoil, which extends along a longitudinal axis from the blade root to the blade tip. The shroud segment includes first and second edges which abut against shroud segments of adjacent blades to make a ring-like shroud. The first and second edges are each provided with a respective side rail on an upper side of the shroud segment. Each of the side rails is subdivided into sections having at least one of a different height and width.

BRIEF DESCRIPTION OF THE DRAWINGS

The subject matter of the disclosure will be explained in more detail in the following text with reference to exemplary embodiments which are illustrated in the attached drawings, in which.

DETAILED DESCRIPTION

The disclosure relates to a gas turbine blade with a shroud segment at the tip of the blade with respect to the geometry of the side rails.

A feature of the blade according to the disclosure is that each of the side rails can be subdivided into sections of different height and/or width.

In a first exemplary embodiment of the inventive blade, a shroud segment includes, on its upper side, a plurality of fins running parallel in a circumferential direction, and the side rails could be subdivided into the sections of different height and/or width by the fins.

A second exemplary embodiment of the blade according to the disclosure includes fins that are inclined with respect to a longitudinal axis of the blade. Especially, the ratio h/b of height to width of the side rails can lie in the range $0.5 \leq h/b \leq 2$, and in an exemplary embodiment the ratio h/b of height to width of the side rails can lie in the range $1.0 \leq h/b \leq 1.3$.

According to another exemplary embodiment of the disclosure, in order to avoid dead zones for the cooling air in the space between the side rails, the shroud segment can be provided with a fillet at the transition from each side rail to the upper side of the shroud segment, with a fillet radius in a range $0.5\ \text{mm} \leq r1, r2 \leq 4.0\ \text{mm}$.

According to another exemplary embodiment of the disclosure openings can be provided in the shroud segment between the fins for injecting cooling air from the inside of the airfoil into the space between the fins.

According to still another exemplary embodiment of the disclosure the first and second edges can be Z-shaped.

Figure 1:
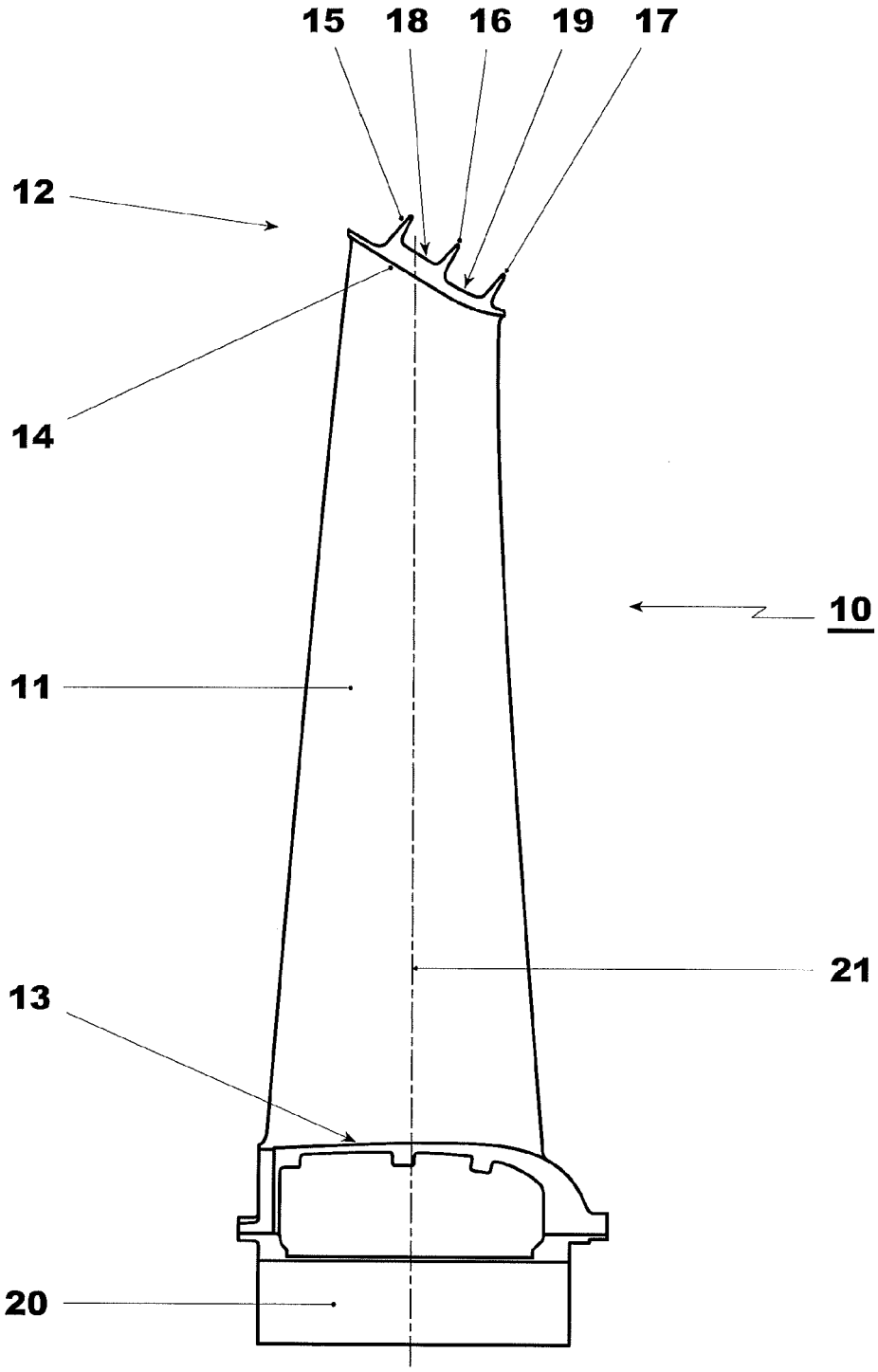
FIG. 1 shows in a side view a blade for a gas turbine according to an exemplary embodiment of the disclosure.
Figure 2:
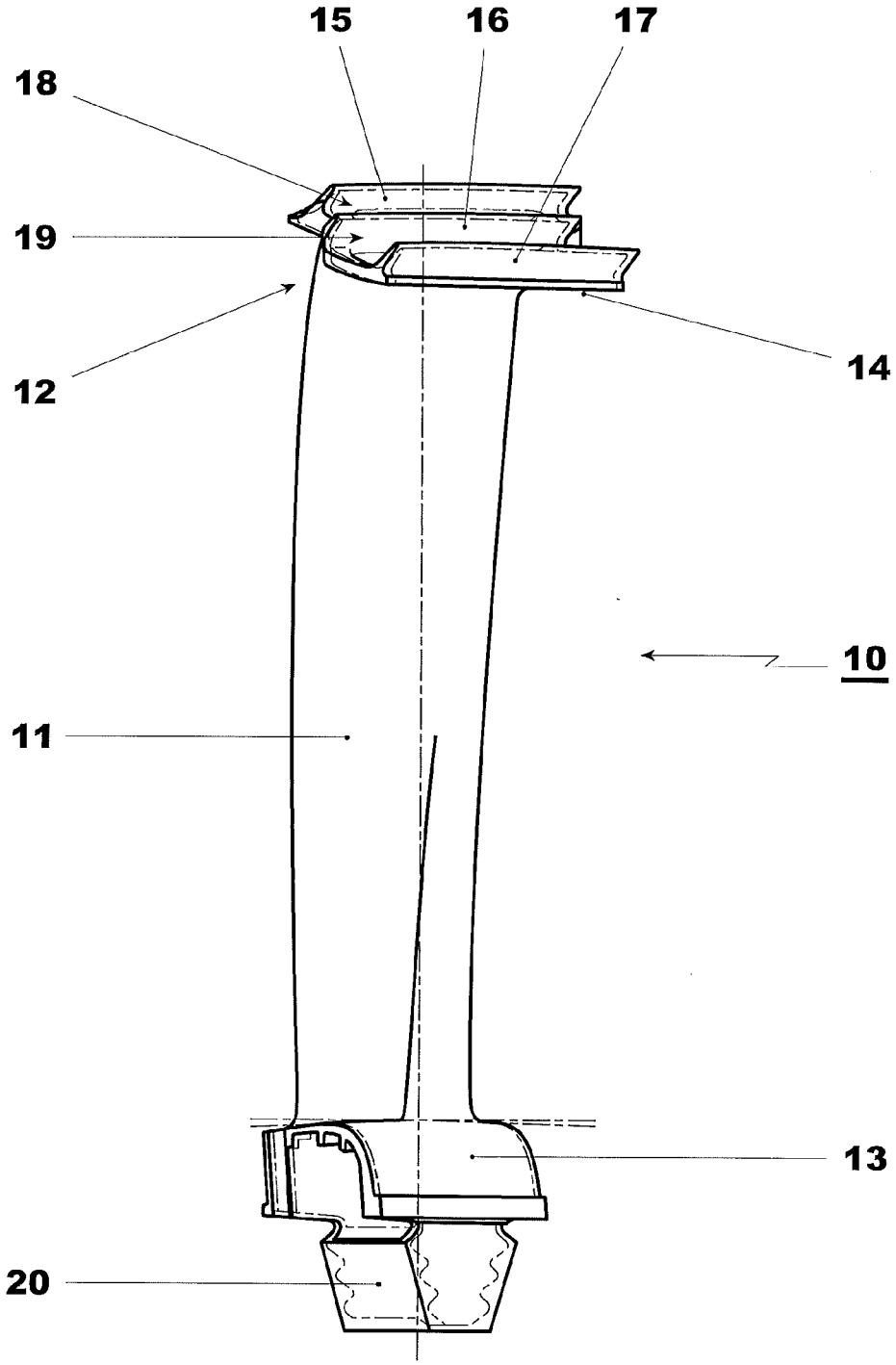
FIG. 2 shows the blade of FIG. 1 in a perspective view.

FIG. 1 shows a side view of a blade 10 for a gas turbine according to an exemplary embodiment of the disclosure. The blade 10 includes an airfoil 11, which extends along a longitudinal axis 21 from a blade root 20 to a blade tip 12. The blade 10 has a platform-like shroud segment 14 at its blade tip 12. Mounted within the gas turbine the shroud segment 14 of the blade 10 abuts with first and second edges (22, 23 in FIG. 3) against similar shroud segments of adjacent blades to make up a ring-like shroud. The ring-like shroud borders the hot gas channel of the turbine and defines a hollow space between the shroud ring and the surrounding stator which can be filled with cooling air. According to the disclosure, the first and second edges 22, 23 can each be provided with a respective side rail 18 and 19 (18*a,b* and 19*a,b* in FIGS. 5 and 6) on the upper side of the shroud segment 14.

Figure 3:
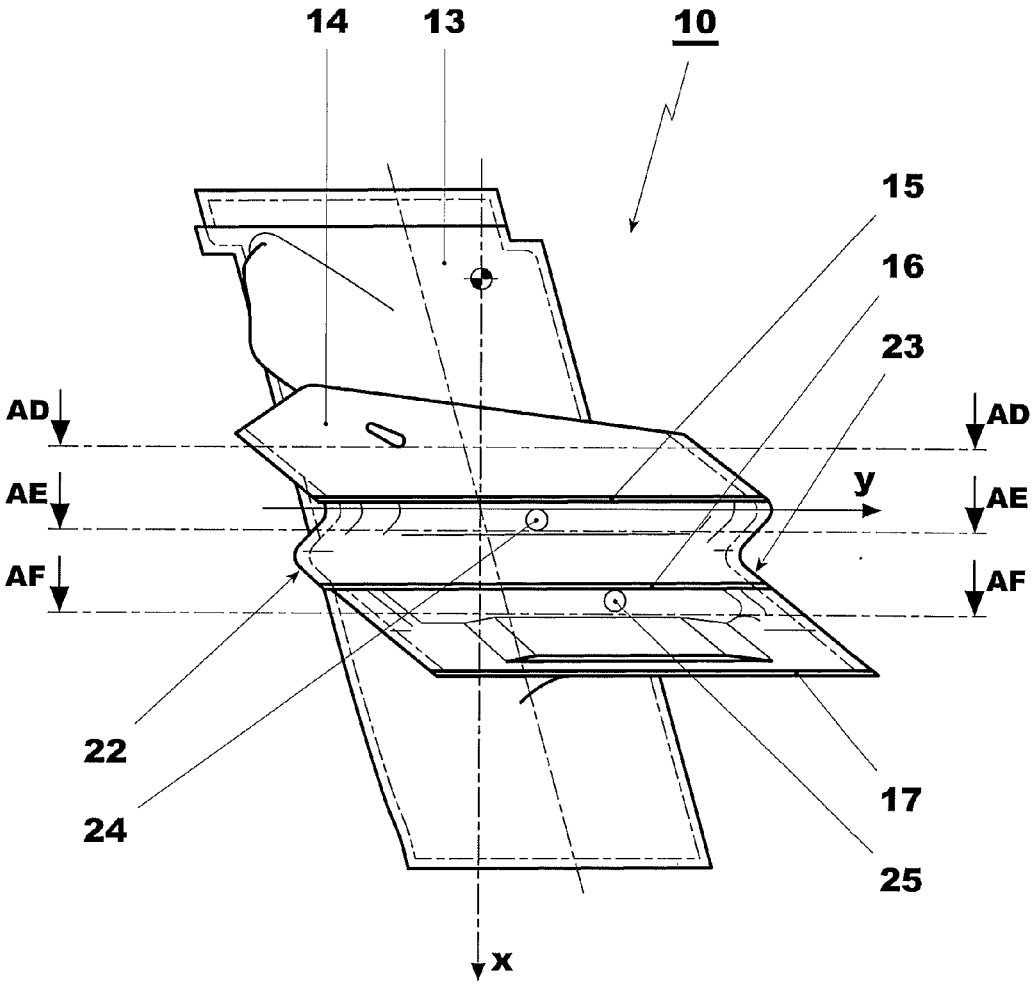
FIG. 3 shows a view from above on the blade according to FIG. 1.
Figure 4:
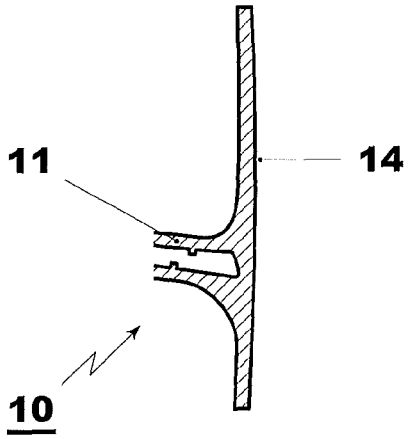
FIG. 4 shows a cross-section of the shroud segment of FIG. 3 along the plane AD-AD.

The shroud segment 14 has, on its upper side, a plurality of fins 15, 16, 17, which can be inclined with respect to the longitudinal axis 21 and run parallel to each other in a circumferential direction (Y in FIG. 3). The side rails can be subdivided into sections 18, 19 of different height (h1, h2 in FIGS. 5 and 6) and/or width (b1, b2 in FIGS. 5 and 6) by the fins 15, 16, 17. For example, between fin 15 and fin 16 there is a first side rail section 18 (cross-section AE-AE in FIGS. 3, 5) with a first height h1 and a first width b1. Between fin 16 and fin 17 there is a second side rail section 19 (cross-section AF-AF in FIGS. 3, 6) with a second height h2 and a second width b2. Outside fin 15, there is no side rail at all (cross-section AD-AD in FIGS. 3, 4).

Figure 5:
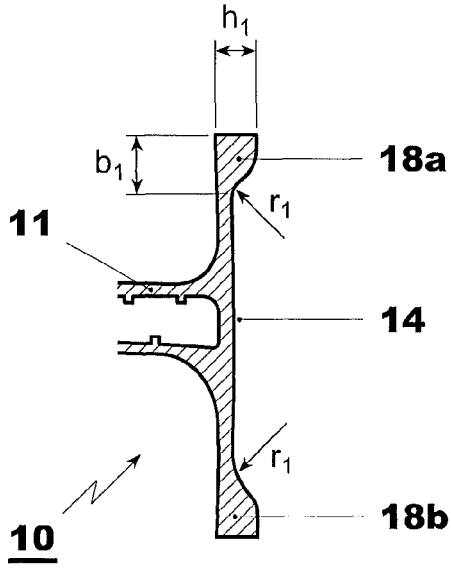
FIG. 5 shows a cross-section of the shroud segment of FIG. 3 along the plane AE-AE.
Figure 6:
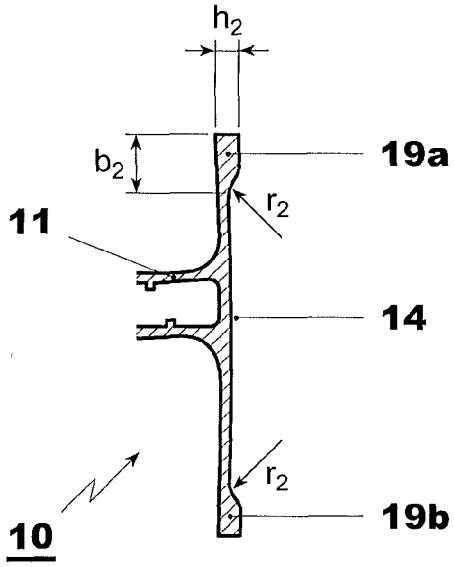
FIG. 6 shows a cross-section of the shroud segment of FIG. 3 along the plane AF-AF.

As can be seen from FIGS. 5 and 6, the height h1 of the side rail section 18 in the central region of the shroud segment 14 between fin 15 and fin 16 can be substantially larger than the height h2 of the side rail section 19 between fin 16 and fin 17. The ratio h/b of height h1, h2 to the respective width b1, b2 of the side rails 18, 19, for example, lies in the range 0.5 h/b 2, and in an exemplary embodiment in the range $1.0 \leq h/b \leq 1.3$. For example, the ratio h1/b1 can amount to 1.3, while the ratio h2/b2 can be 1.0.

The shroud segments 14 of the shroud ring with their fins 15, 16 and 17 can define, together with the surrounding stator, two ring-like hollow spaces, which can be cooled by cooling air. To receive cooling air from the hollow inside of the airfoil 11 (see FIGS. 4-6), openings 24, 25 can be provided in each shroud segment 14 between the fins 15, 16 and 17, through which cooling air can be injected into the space between the fins 15, 16 and 17.

In order to avoid dead zones for the cooling air in the space between the side rails 18, 19, the shroud segment 14 can be provided with a fillet at the transition from each side rail 18*a,b* and 19*a,b* to the upper side of the shroud segment 14, with the respective fillet radius r1, r2 lying in a range $0.5\ \text{mm} \leq r1$, $r2 \leq 4.0$ mm.

As can be seen in FIG. 3, the first and second edges 22, 23 of the shroud segment 14 can be Z-shaped, whereby the edges 22, 23 run parallel between fins 16 and 17 and outside of fin 15, while they show a Z-like curvature between fins 15 and 16.

Thus, it will be appreciated by those having ordinary skill in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

LIST OF REFERENCE NUMERALS

10 Blade
11 Airfoil
12 Blade tip
13 Platform
14 Shroud segment
15,16,17 Fin
18,19 Side rail
18*a,b* Side rail
19*a,b* Side rail
20 Blade root
21 Longitudinal axis (blade)
22,23 Edge
24,25 Opening
r1, r2 Filet radius
h1, h2 Height
b1, b2 Width
X Axial direction (machine axis)
Y Circumferential direction (direction of rotation)

What is claimed is:

1. A blade for a gas turbine, comprising:
a blade root;
a blade tip;
a shroud segment formed at the blade tip; and
an airfoil, which extends along a longitudinal axis from the blade root to the blade tip, wherein the shroud segment includes first and second edges which abut against shroud segments of adjacent blades to make a ring-like shroud, the first and second edges being each provided with a respective side rail on an upper side of the shroud segment, wherein the shroud segment comprises on its upper side:
a plurality of fins running parallel in a circumferential direction, wherein the side rails are subdivided into sections having at least one of a different height and a different width, wherein extending from a first fin to a second fin is a first side rail section having side rails of a first height and a first width, and wherein extending from the second fin to the third fin is a second side rail section having side rails of a second height different from the first height and of a second width different from the first width.

2. The blade as claimed in claim 1, wherein the fins are inclined with respect to the longitudinal axis of the blade.

3. The blade as claimed in claim 1, wherein the ratio h/b of height to width of the side rails lies in a range $0.5 \leq h/b \leq 2$.

4. The blade as claimed in claim 3, wherein the ratio h/b of height to width of the side rails lies in a range $1.0 \leq h/b \leq 1.3$.

5. The blade as claimed in claim 1, wherein the shroud segment comprises:
a fillet at a transition from each side rail to the upper side of the shroud segment, the fillet having a radius in a range of $0.5\ \text{mm} \leq r1$, $r2 \leq 4.0$ mm to avoid dead zones for cooling air in a space between the side rails.

6. The blade as claimed in claim 1, wherein the shroud segment comprises:
an opening between the fins for injecting cooling air from inside of the airfoil into a space between the fins.

7. The blade as claimed in claim 1, wherein the first and second edges are substantially Z-shaped.

8. The blade as claimed in claim 1, wherein the ratio h/b of height to width of the side rails lies in a range $0.5 \leq h/b \leq 2$.

9. The blade as claimed in claim 2, wherein the ratio h/b of height to width of the side rails lies in a range $0.5 \leq h/b \leq 2$.

10. The blade as claimed in claim 1, wherein the shroud segment comprises:
a fillet at a transition from each side rail to the upper side of the shroud segment, the fillet having a radius in a range of $0.5\ \text{mm} \leq r1$, $r2 \leq 4.0$ mm to avoid dead zones for cooling air in a space between said side rails.

11. The blade as claimed in claim 2, wherein the shroud segment comprises:

a fillet at a transition from each side rail to the upper side of the shroud segment, the fillet having a radius in a range of 0.5 mm≤r1, r2≤4.0 mm to avoid dead zones for cooling air in a space between said side rails.

12. The blade as claimed in claim 4, wherein the shroud segment comprises:

a fillet at a transition from each side rail to the upper side of the shroud segment, the fillet having a radius in a range of 0.5 mm≤r1, r2≤4.0 mm to avoid dead zones for cooling air in a space between said side rails.

13. The blade as claimed in claim 9, wherein the shroud segment comprises:

a fillet at a transition from each side rail to the upper side of the shroud segment, the fillet having a radius in a range of 0.5 mm≤r1, r2≤4.0 mm to avoid dead zones for cooling air in a space between said side rails.

14. The blade as claimed in claim 1, wherein the shroud segment comprises:

an opening between the fins for injecting cooling air from inside of the airfoil into a space between the fins.

15. The blade as claimed in claim 2, wherein the shroud segment comprises:

an opening between the fins for injecting cooling air from inside of the airfoil into a space between the fins.

16. The blade as claimed in claim 4, wherein the shroud segment comprises:

an opening between the fins for injecting cooling air from inside of the airfoil into a space between the fins.

17. The blade as claimed in claim 5, wherein the shroud segment comprises:

an opening between the fins for injecting cooling air from inside of the airfoil into a space between the fins.

18. The blade as claimed in claim 12, wherein the shroud segment comprises:

an opening between the fins for injecting cooling air from inside of the airfoil into a space between the fins.

* * * * *